US005426906A

United States Patent [19]

McCracken

[11] Patent Number: 5,426,906

[45] Date of Patent: * Jun. 27, 1995

[54] BEAM MEMBER FOR USE IN CONCRETE FORMING APPARATUS

[75] Inventor: Robert G. McCracken, Des Moines, Iowa

[73] Assignee: Wilian Holding Company, Des Moines, Iowa

[ * ] Notice: The portion of the term of this patent subsequent to May 3, 2011 has been disclaimed.

[21] Appl. No.: 183,148

[22] Filed: Jan. 18, 1994

Related U.S. Application Data

[63] Continuation of Ser. No. 832,018, Feb. 6, 1992, Pat. No. 5,307,601.

[51] Int. Cl.[6] ..... E04H 12/08

[52] U.S. Cl. ..... 52/650.1; 52/730.4; 52/731.2; 52/732.2; 52/474

[58] Field of Search ..... 52/364, 474, 632, 720, 52/730.4, 731.2, 732.1, 650.1

[56] References Cited

U.S. PATENT DOCUMENTS

| | | | |
|---|---|---|---|
| 2,020,062 | 11/1935 | Jackson | 52/364 |
| 2,457,250 | 12/1948 | Macomber | 52/364 |
| 3,834,103 | 9/1974 | Knohl | 52/732.1 |
| 4,003,168 | 1/1977 | Brady | 52/731 |
| 4,742,655 | 5/1988 | Kovasna | 52/364 |
| 5,307,601 | 5/1994 | McCracken | 52/364 |

*Primary Examiner*—Carl D. Friedman
*Assistant Examiner*—Christopher Todd Kent
*Attorney, Agent, or Firm*—Kent A. Herink; Brian J. Laurenzo; Brett J. Trout

[57] ABSTRACT

A light-weight, high-strength beam member for use in concrete form assemblies. A sheet material is roll-formed into a hollow beam having a trapezoidal transverse cross section. In assembly, a plurality of beam members are attached to a supporting metal concrete forming structure in a parallel, spaced-apart relation. Sheeting or decking is attached to the plurality of beam members by hand driven nails which penetrate a top section the beam members.

16 Claims, 3 Drawing Sheets

BEAM MEMBER FOR USE IN CONCRETE FORMING APPARATUS

This application is a continuation application of Ser. No. 07/832,018, filed Feb. 6, 1992, now U.S. Pat. No. 5,307,601.

BACKGROUND OF THE INVENTION

The invention relates generally to beam members used in concrete forming apparatus and, more specifically, to a lightweight steel beam member of trapezoidal cross section having a top portion that is penetrable by a hand driven nail for the attachment of sheeting to the beam member.

Concrete forming systems are well known and widely used in the construction of diverse concrete structures. Certain of these systems make use of beam sections or soldiers as upright and horizontal structural members, inclined braces, columns, shores, walers, and the like. One such beam section or soldier is described in U.S. Pat. No. 4,964,256. In concrete forming systems utilizing beam sections and in a large variety of other types of concrete forming systems, sheeting or decking is frequently used to create a substantially flat concrete forming surface for the forming of horizontal floor or roof sections and vertical wall sections. Such forms employ a plurality of beam members placed across and secured to other structural members of the concrete forming system such as the beam sections or soldiers described above.

An example of a typical prior art beam member is described in U.S. Pat. No. 3,899,152. The described prior art beam member is formed of extruded aluminum and has an upper, inverted top hat shaded portion which receives a strip of wood into which the sheeting or decking is nailed or screwed. While the extruded aluminum beam members are lightweight and, with the inclusion of the wooden nailing strip, have satisfactory deflection resistance, aluminum is expensive and the wooden nailing strip adds to the weight of the assembled beam member.

SUMMARY OF THE INVENTION

The invention consists of a beam member formed of a sheet material for use in concrete forming assemblies. The beam member is of a substantially trapezoidal shape in transverse cross section, having a substantially planar top section and a substantially planar bottom section of a length coextensive with the top section and centered relatively transversely and a uniform distance below the top section. A pair of web sections interconnect the top section and the bottom section along corresponding longitudinal edges thereof. A plurality of apertures having inwardly turned flanges are formed in the web sections to provide hand access by a user to the interior of the beam member. In the preferred embodiment, the beam member is formed of high strength steel by roll-forming and continuous welding techniques. The resulting beam member is lighter in weight than an equivalent length extruded aluminum beam member including its wooden insert. Sheeting or decking may be attached to the top section of an assembly of beam members by hand driven nails which penetrate the top portion of the beam member. When horizontally supported on the bottom portion, the beam member has sufficient torsional strength and stability to permit a user of the beam members to walk on the top portion in the process of assembling a concrete forming apparatus.

An object of the present invention is to provide a beam member for use in horizontal floor or roof forms or vertical wall forms as a part of a concrete forming system.

Another object of the invention is to provide a beam member that is roll-formed from a sheet of high strength steel and having a top portion that is penetrable by a hand driven nail.

A further object of the invention is to provide a beam member formed of high strength steel and which has a weight per length at least as low as an assembled extruded aluminum beam member.

Yet another object of the invention is to provide a beam member formed of high strength steel and which has a deflection resistance at least equal to that of an extruded aluminum beam member.

These and further objects of the invention will become apparent upon a review of the following specification, attached drawings, and claims.

DETAILED DESCRIPTION OF A PREFERRED EMBODIMENT

Figure 1:
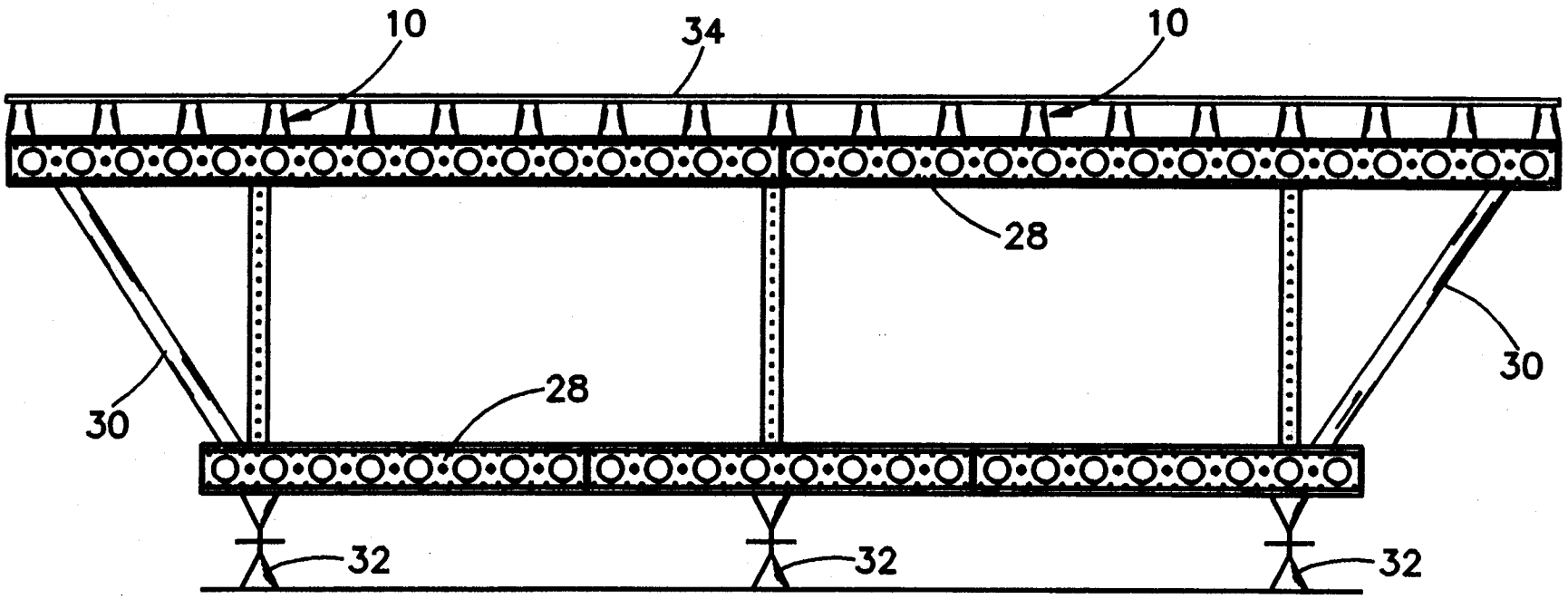
FIG. 1 is an elevational view of a metal concrete form assembly wherein a plurality of interconnected beam members of the present invention are supporting decking on which a horizontal floor section may be poured.

Illustrated in FIGS. 3–8, generally at 10, is a beam member having a substantially trapezoidal transverse cross section. The beam member 10 has a substantially planar top section 12 of a uniform width and a substantially planar bottom section 14 of a uniform width greater than the width of the top section 12. A pair of web sections 16 and 18 interconnect the top section 12 and bottom section 14 along corresponding longitudinal edges thereof such that the bottom section 14 is centered relatively transversely below and parallel to the top section 12. The top section 12, bottom section 14, and web sections 16 and 18 are coextensive in length.

A plurality of apertures 20 are formed at regular spaced intervals in the web sections 16 and 18. In the preferred embodiment, the apertures 20 are circular and have an inwardly turned flange 22.

Figure 6:
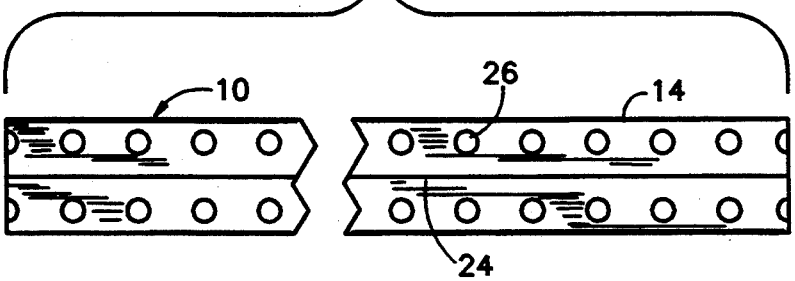
FIG. 6 is a bottom view of the beam member.
Figure 7:
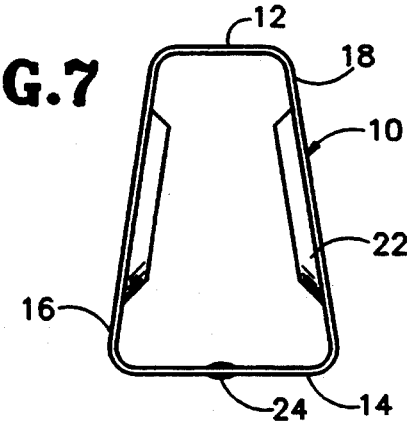
FIG. 7 is an end view of the beam member.
Figure 8:
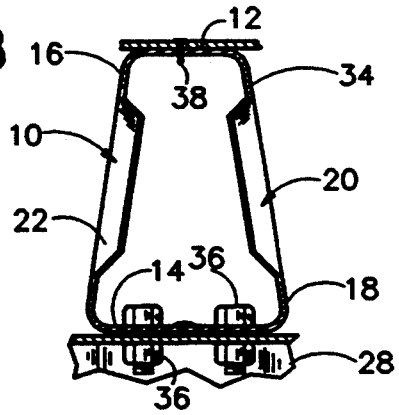
FIG. 8 is a transverse cross-sectional view of the beam member taken along line 8—8 of FIG. 4.

The beam member 10 is formed of a sheet material by roll forming techniques. The longitudinal side edges of the sheet material meet along the longitudinal centerline of the bottom section 14 and are joined therealong at 24 such as by continuous induction welding (FIGS. 6, 7 and 8).

In the preferred embodiment, the beam member 10 is formed of high strength steel the meets the standard A446 of the American Society for Testing and Materials (ASTM) and is of a gauge of 0.070 inches (55 ksi minimum). The top section is 2 inches wide and the bottom section is 5 inches wide. The height of the beam member 10 is $6\frac{1}{2}$ inches. The apertures 20 have a radius of $1\frac{7}{8}$ inches prior to creation of the 45 degree embossed $\frac{3}{8}$ inch flange 22. The apertures 20 are on 6-inch centers. A plurality of bolt receiving apertures 26 (FIGS. 3 and 6) are formed in the bottom section 14 on 2-inch centers spaced $1\frac{1}{2}$ inches on either side of the longitudinal centerline of the bottom section 14. The beam members 10 may be made of any desired length.

Figure 2:
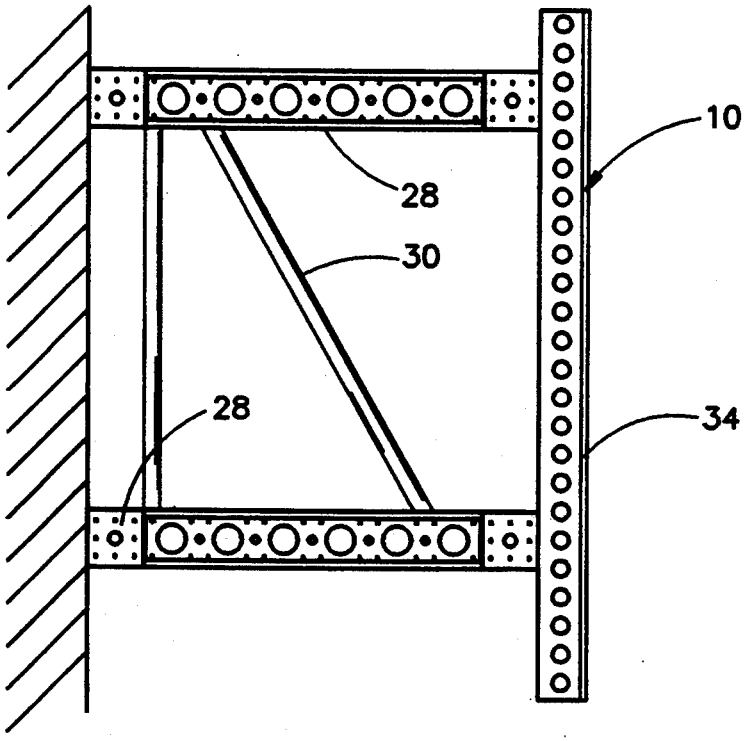
FIG. 2 is an elevational view of the metal concrete form assembly wherein a plurality of interconnected beam members of the present invention are supporting decking or sheeting for the forming of a vertical wall section.
Figure 3:
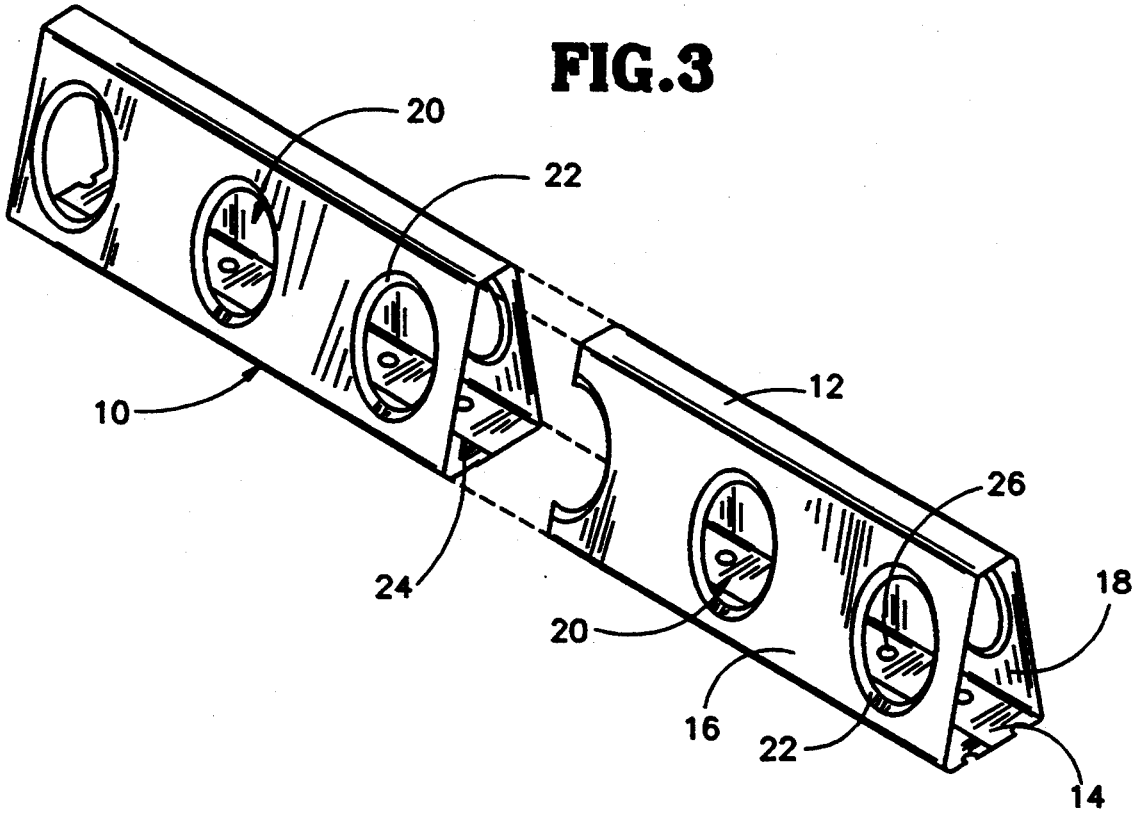
FIG. 3 is a perspective view of the beam member.
Figure 4:
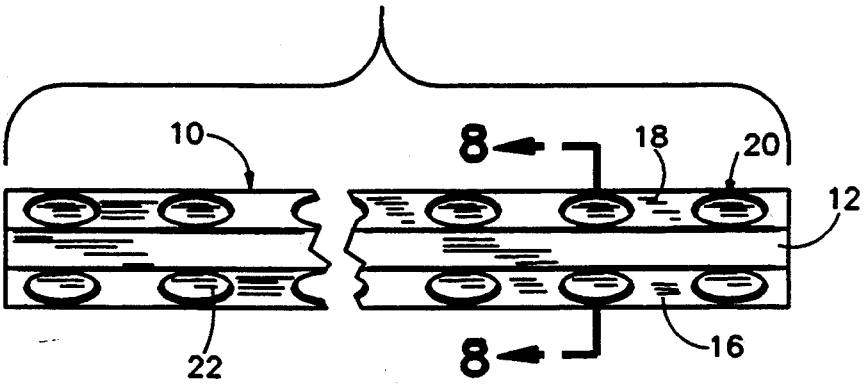
FIG. 4 is a top plan view of the beam member.
Figure 5:
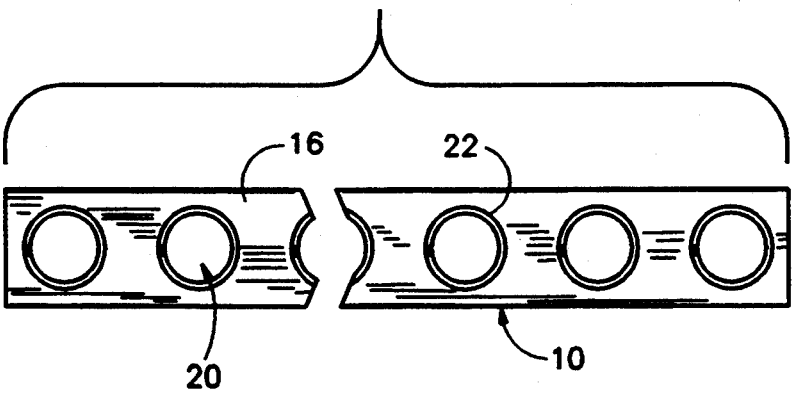
FIG. 5 is a side elevational view of the beam member.

In use, the beam members 10 form a part of a metal concrete forming system wherein they are used to support sheeting or decking (which in the industry is typically comprised of plywood panels) against which a horizontal floor or roof section (FIG. 1) or vertical wall section (FIG. 2) is formed. A plurality of beam sections 28 are interconnected in a known manner to create a structural section of the concrete forming assembly. The beam sections 28 illustrated in FIGS. 1 and 2 are of the type described in U.S. Pat. No. 4,964,256, which is incorporated herein by this reference. The metal concrete forming assemblies also includes diagonal braces 30. A number of support screw jacks 32 tile horizontal assembly (FIG. 1) while tile vertical assembly (FIG. 2) is attached to an existing wall 40 or similar structure. A plurality of the beam members 10 are placed against the beam sections 28 of tile metal concrete forming assemblies in a parallel, spaced apart relation. The beam members 10 are releasably secured to the beam sections 28 by a plurality of nut and bolt combinations 36 (FIG. 8) received through the apertures 26 and coaligned bolt receiving apertures of the beam sections 28. Hand access to tile interior of the beam members for the purpose, for example, of installing the nut and bolt combinations 36 is provided through the apertures 20.

When in place on the metal concrete forming apparatus as illustrated in FIG. 1, the beam members 10 have sufficient torsional stability to permit a user of the metal concrete forming assembly to walk atop the beam members 10 as is common with the extruded aluminum beam members of the prior art. Sheeting or decking 34 is placed a top the plurality of beam members 10 arid releasably secured thereto by a plurality of nails 38 (FIG. 8). The materials used in forming the beam member 10 provide the required strength to the beam member 10 while also being penetrable by a hand driven nail 38 used to attach the sheeting 34 to the top section 12 thereof. When the metal concrete form assembly is to be removed from the cured concrete section formed thereagainst, the metal concrete form assembly may be "flown" using known construction techniques to another working position. To disassemble the metal concrete forming assembly, the sheeting or decking 34 can be removed from the beam members 10 either by hammer or other impact tool. It has been found that once a section of an individual sheeting panel has been freed, a user of the beam members 10 typically can manually remove the remainder of the panel and associated nails 38 by lifting of the free edge of the sheet directly.

It has been found that satisfactory beam members can be formed of high strength steel with the following parameters: A top section of between about $1\frac{1}{4}$ inches and about 3 inches in width; a bottom section of between about 3 inches and about 6 inches in width; web sections of between about 3 inches and about 8 inches in width; and high strength steel of a gauge between about 0.035 inches and 0.10 inches. It is important in constructing beam members within the above-recited parameters that the interior angle of the web sections relative to the bottom section be maintained between about 70 degrees and about 80 degrees. In general, beam members of smaller dimensions will meet the same strength requirements as beam members of larger dimensions if made of heavier gauge steel.

The apertures provide for hand access to the interior of the beam member, serve to lighten the weight of the beam member and provide convenient means for handling of the beam member. It has been found that the creation of inwardly turned flanges around the periphery of the apertures returns a significant proportion of the strength lost due to the existence of the apertures. Of course, apertures that are either too large or too closely spaced may diminish the strength of the resulting beam member below that required for its intended purpose.

Although the invention has been described with respect to a preferred embodiment thereof, it is to be also understood that it is not to be so limited since changes and modifications can be made therein which are within the full intended scope of this invention as defined by the appended claims.

I claim:

1. A structural framing member formed of a single piece of nail-penetrable sheet metal and having a trapezoidal transverse cross-section, said structural framing member comprising:

(a) a first planer section;

(b) a second planar section coextensive in length with said first planer section and of a width greater than said first planer section; and (c) a pair of web sections of uniform width coextensive in length with said first planer section and said section planer section, and interconnecting said first planer section and said second planer section along corresponding adjacent edges thereof, said pair of web sections being connected to one another by said first planer section to form the structural framing member having the trapezoidal transverse cross-section.

2. The structural framing member of claim 1, wherein said web sections are provided with apertures of a sufficient size to allow hand access by a user to the interior of the structural framing member.

3. The structural framing member of claim 2, further comprising inwardly turned flanges bordering said apertures.

4. The structural framing member of claim 3, wherein said flanges and said apertures are circular.

5. The structural framing member of claim 1, wherein said first planar section and said second planar section are generally rectangular.

6. The structural framing member of claim 1, wherein the nail-penetrable sheet metal is high strength steel of a thickness between about 0.035 inches and about 0.10 inches.

7. The structural framing member of claim 6, wherein said first planar section is of a width between about $1\frac{1}{4}$ inches and 3 inches, said second planar section is of a width between said second planar section are separated by between about 3 inches and about 7 inches.

8. The structural framing member of claim 7, wherein said second planar section and said web sections define an internal angle of between about 70 degrees and about 80 degrees.

9. A frame assembly comprising:

(a) a structural framing member formed of a single piece of nail-penetrable sheet metal into a trapezoidal transverse cross-section, said structural framing member comprising:

(i) a first planer section;

(ii) a second planer section coextensive in length with said first planer section and of a width greater than said first planer section; and (iii) a pair of web sections of uniform width coextensive in length to said first planer section and said second planer section and interconnecting said first planer section and said second planer section along corresponding adjacent edges thereof said pair of web sections being connected to one another by said first planer section, to form the structural framing member having said trapezoidal transverse cross-section;

(b) a sheeting material in supported engagement with said first planer section of said structural framing member; and (c) fastening means penetrating said sheeting material and said first planer section of said structural framing member for maintaining said sheeting material in supported engagement with said first planer section of said structural framing member.

10. The framing assembly of claim 9, wherein said web sections are provided with apertures of a sufficient size to allow hand access by a user to the interior of said structural framing member.

11. The framing assembly of claim 10, further comprising inwardly turned flanges bordering said apertures.

12. The framing assembly of claim 11, wherein said flanges and said apertures are circular.

13. The framing assembly of claim 9, wherein said first planar section and said second planar section are generally rectangular.

14. The framing assembly of claim 9, wherein said nail-penetrable sheet metal is high strength steel of a thickness between about 0.035 inches and about 0.10 inches.

15. The framing assembly of claim 14, wherein said first planar section is of a width between about 1¼ inches and 3 inches, said second planar section is of a width between about 3 inches and 6 inches, and said first planar section and said second planar section are separated by between about 3 inches and about 7 inches.

16. The framing assembly of claim 15, wherein said second planar section and said web sections define an internal angle of about 70 degrees and about 80 degrees.

* * * * *